US005412396A

United States Patent [19]

Nelson

[11] Patent Number: 5,412,396

[45] Date of Patent: May 2, 1995

[54] DRIVER CIRCUIT FOR SHUTTERS OF A FLAT PANEL DISPLAY

[75] Inventor: Terence J. Nelson, New Providence, N.J.

[73] Assignee: Bell Communications Research, Inc., Livingston, N.J.

[21] Appl. No.: 149,263

[22] Filed: Nov. 9, 1993

Related U.S. Application Data

[63] Continuation of Ser. No. 49,038, Apr. 16, 1993, Pat. No. 5,311,206.

[51] Int. Cl.[6] ..... G09G 3/36

[52] U.S. Cl. ..... 345/89; 345/102; 345/148

[58] Field of Search ..... 345/89, 102, 148, 98, 345/87, 70; 377/107

[56] References Cited

U.S. PATENT DOCUMENTS

| | | | |
|---|---|---|---|
| 4,743,096 | 5/1988 | Wakai et al. | 345/89 |
| 4,872,059 | 10/1989 | Shinabe | 345/89 |
| 4,907,862 | 3/1990 | Suntola . | |
| 4,924,215 | 5/1990 | Nelson . | |
| 5,011,269 | 4/1991 | Wakita et al. | 345/89 |
| 5,018,007 | 5/1991 | Lang et al. . | |
| 5,083,120 | 1/1992 | Nelson . | |

OTHER PUBLICATIONS

J. Kanbe et al, "FLCDs Offer Many Desirable Characteristics", Dis-lay Devices, 1992, pp. 18–20.

S. Tsuboyama et al, "S3-1 Invited Characteristics of the Large Size, High Resolution FLCD", Japan Display 1992, pp. 53–56.

T. J. Nelson, "Leaky Lightguide/LED Row-Backlight, Column-Shutter Display," IEEE Trans. on Electronic Devices, vol. 38, No. 11, 1991, pp. 2567–2569.

T. J. Nelson et al, "Row-Backlight, Column-Shutter Display Concept" Appl. Phys. Lett., vol. 52, No. 13, Mar. 1988, pp. 1034–1036.

T. J. Nelson et al, "Row-Backlight, Column-Shutter Display: A New Display Format", Displa-s, Apr. 1989, pp. 76–80.

T. Scheffer et al, "Supertwisted Nematic (STN) LCDs", SID 1992, M-1/1-M-1/52.

*Primary Examiner*—Richard Hjerpe
*Assistant Examiner*—Vivian W. Chang
*Attorney, Agent, or Firm*—Leonard Charles Suchyta; James W. Falk

[57] ABSTRACT

A flat-panel display device 500, 600 with an active array of parallel longitudinal row backlights 520, 620 disposed in a first plane is disclosed. The row backlights sequentially emit a row of light for a fixed-duration row-interval of time t in successive row periods of duration p. Each row is illuminated once in each frame. The flat panel display device also has an array of longitudinal parallel liquid-crystal column shutters 531, 631 disposed in a second plane parallel to the first plane. The column shutters are oriented orthogonally to the row backlights so as to define pixels at each intersection of a column shutter and a row backlight. A driver 590, 690 is provided for causing the column shutters to make, at most, one transition from the "off" state to the "on" state or vice-versa every row period.

2 Claims, 13 Drawing Sheets

$C_m$ $C_{m-1}$ $C_0$

DRIVER CIRCUIT FOR SHUTTERS OF A FLAT PANEL DISPLAY

This is a continuation of application Ser. No. 08/049,038, filed Apr. 16, 1993, now U.S. Pat. No. 5,311,206, issued May 10, 1994.

RELATED APPLICATIONS

The following patents are related to the subject matter of the present application and are assigned to the assignee hereof:

1. U.S. Pat. No. 4,924,215, entitled "Flat Panel Color Display Comprising Backlight Assembly and Ferroelectric Liquid Crystal Shutter Assembly," filed Apr. 12, 1988 for Terence J. Nelson, and 2. U.S. Pat. No. 5,083,120, entitled "Flat Panel Display Using Leaky Lightguides," filed Feb. 23, 1990 for Terence J. Nelson.

The contents of the above patents are incorporated herein by reference.

FIELD OF THE INVENTION

The present invention relates to display devices. More particularly, the present invention relates to a flat-panel display device having an active backlight which is divided into rows and a liquid-crystal modulator which is divided into columns. Each row successively emits a row of light for a certain row-time interval of a row period. The liquid-crystal modulator includes a linear array of independently operable column shutters. The flat-panel display device has a unique driver which causes the column shutters to change from one polarization-modulating state to the other at most once during each row period. This permits the display of images with a broad grey scale and full range of colors without sacrificing resolution.

BACKGROUND OF THE INVENTION

The term display device broadly refers to any device which is capable of reproducing images. Such devices are commonly used in televisions for regenerating images from radio waves or in video-display terminals for reproducing images generated by a computer. In addition, display devices could be incorporated with a communication device, such as a telephone, for displaying choices of telephone services which may be selected by the user.

Most display devices in use are of the cathode-ray tube (CRT) type 10 shown in FIG. 1. The cathode-ray tube 10 is an elongated vacuum chamber having a cathode 12 at one end and a cathodoluminescent phosphor screen 14 at the other end. In a typical CRT 10, the cathode 12 emits a beam of electrons 16 that is deflected by a deflection coil 18 in a raster scan over the phosphor screen 14. The phosphor screen 14 converts part of the electron energy into light. CRT's have a good color and grey scale range. Furthermore, the brightness of the image produced on the screen looks about the same from any viewing angle. The principle disadvantage of the CRT is its bulky glass envelope which must be long to allow the emitted electron beam to be deflected over the entire screen. Furthermore, the glass envelope must be strong enough to prevent the weight of the atmosphere outside from crushing the tube or otherwise filling the vacuum inside.

Flat-panel liquid-crystal display (LCD) devices have become more readily available on the market, particularly in lap-top computers and portable televisions for which CRTs are impractical. Generally, LCDs include a liquid-crystal modulator which modulates a polarization-encoded image onto a linearly polarized input light beam. The polarization-encoded image may then be revealed by an analyzer, e.g., a polarizer.

Almost all LCDs can trace their origin to the twisted-nematic display which has a liquid-crystal modulator made with a nematic liquid-crystal substance. Nematic liquid-crystals have just one unliquid-like property; their elongated molecules prefer to be aligned with one another. These aligned molecules can be made to twist relative to one another by a predetermined amount, thereby forming a helical structure referred to as a twisted-nematic (TN).

A TN liquid-crystal modulator 100 is shown in FIG. 2(*a*). As shown, the TN liquid-crystal material 110 is disposed between two flat substrates 112 and 114 covered by alignment layers. The two alignment layers are specially designed so that the molecules 110-1 and 110-2 of the liquid-crystal material 110 tend to align with a particular direction 122 or 124 of the alignment layers 112 and 114, respectively. The alignment layers 112 and 114 have directions 122 and 124 which are orthogonally separated by a 90° angle. In such a case, the liquid-crystal material 110 forms a TN structure which is anchored on both substrates 112 and 114, as depicted.

If light, which is polarized in a direction 126 in the plane of the alignment layers, passes through the liquid-crystal modulator 100, its polarization 125 will be rotated by 90° by the TN structure provided that:

$$\Delta n \cdot d >> \lambda_{light} \quad (1)$$

where $\Delta n$ is the difference between the extraordinary and the ordinary indices of refraction ($n_{ext} - n_{ord}$) of the liquid-crystal material 110, d is the thickness of the modulator and $\lambda_{light}$ is the wavelength of the polarized light.

If a few volts are applied between the two substrates 112 and 114, the molecules of the liquid-crystal material align with the electric field, as shown in FIG. 2(*b*). The polarization of light 125 passing through the modulator 100 would be unchanged. The modulated light subsequently passes through an analyzer 130, which transmits light polarized in a particular direction 128, e.g., the same direction as the direction 126 of the polarized light before it passes through the modulator 100. If the light exits the modulator 100 with the same polarization direction 128 as the analyzer 130, it is transmitted by the analyzer 130. The modulator 100 is said to be in an "on" state. If the light exits the modulator 100 with the other polarization, i.e., with a polarization direction 124 at right angles to the polarization direction of the analyzer 130, it is blocked by the analyzer 130. The modulator is then said to be in an "off" state.

Typically, two polarizers are used in a TN-LCD device, namely, a polarizer which produces, from an unpolarized light source, the initial polarized light with the direction 126 that is incident on the liquid-crystal modulator 100 of the TN-LCD device and the analyzer 130.

Illustratively, as shown in FIG. 3, the modulator 100 is divided into picture elements or pixels 140 by forming a linear array of transparent (e.g., indium tin oxide or ITO) conductors 150-1, 150-2, . . . , 150-I and 160-1, 160-2, . . . , 160-J on each respective substrate 112 and 114 under the alignment layers, so that the conductors under one layer (e.g., covering the substrate 112) are orthogonal to the conductors under the other layer (e.g., covering the substrate 114). Pixels are formed in regions where the orthogonal conductors (e.g., 150-1 and 160-1) under the two alignment layers cross. The absence or presence of an electric field applied to a pixel 140 determines the response of the pixel 140 and thus whether the pixel 140 will appear dark or light when viewed through the analyzer 130 (FIG 2(*b*)). Select voltages are sequentially applied to the pixel row conductors (e.g., the conductors 150-1, 150-2, . . . , 150-I) one at a time. Column voltages are applied to the column conductors (e.g., the conductors 160-1, 160-2, . . . , 160-J) depending on whether the pixel in that column is on or off for a given row.

As shown in FIG. 3, a single longitudinal column electrode (e.g., 160-1, 160-2, . . . , 160-J) is used for each pixel of a particular column. Thus, when a voltage is applied to any pixel via its respective row and column conductors, all of the pixels in the particular column of that pixel will experience a voltage, albeit, not as strong as the voltage across the pixel associated with the row conductor to which a voltage is applied. Such extraneous voltages increase the field on a pixel that is supposed to remain off. For this reason, the pixelated TN-LCD modulator 100 is limited in the number of rows which can be displayed. In a frame time F, N rows are displayed, each during a row-time period p (F=Np). The liquid crystal responds to the rms (root mean square) voltage applied to it. However, when the select voltage is applied with a duty cycle of only 1/N, it is hard to achieve a large enough ratio of $V_{on}^{rms}$ to $V_{off}^{rms}$. This is partly because the TN liquid crystal does not change between the two states shown in FIGS. 2*a* and 2*b* over a sufficiently small range in voltage. Thus, for a TN structure, the number of rows N which can be displayed on a TN-LCD is less than 100. Furthermore, in order to construct a TN-LCD capable of displaying that many rows, the electro-optic response of the liquid-crystal modulator is compromised so that the "on" and "off" states of the pixels are no longer in ideal alignment with the electric field and 90° twist, respectively. As such, the contrast ratio for light traveling in some directions is reduced from what can be achieved with a continuously applied voltage wave form, thereby reducing the viewing-angle range.

It is disadvantageous to apply a constant DC voltage to the liquid-crystal modulator as this tends to break down the liquid-crystal therein. Therefore, the polarity of the applied voltage is reversed periodically to cancel the DC component.

An improved LCD called a supertwist nematic LCD (or STN-LCD) is available in which the twist angle of the modulator is increased from 90° to between 200° and 270°. STN-LCDs permit displays with 200 to 240 rows thus making popular 640×480 display devices possible (e.g., using two adjacent STN-LCDs of 240 rows each on the same glass plate substrates). STN-LCDs are disadvantageous because they are slow. A STN liquid-crystal modulator, to which optimum voltages are applied, can have a transmission response which decays quickly after a voltage is applied. But, this also causes the pixels to "relax" from the bright or "on" state to the dark or "off"-state in between frames, thereby reducing brightness and contrast. However, STN liquid-crystal displays are usually designed so that their response does not decay rapidly in between the application of voltages (i.e., in between frames). Such STN-LCDs must be driven with "on" state and "off" state rms voltages with a low duty cycle. The net result is an STN-LCD which is slow; i.e., moving images often disappear from the screen in an effect called "submarining". This makes it difficult to implement a "mouse" or trackball pointer. Furthermore, grey scales (and thus full color) can only be implemented with spatial or temporal dithering. In spatial dithering, the pixels of the modulator are treated as sub-pixels which are grouped together to form pixels of the display. To display a grey level, none, all, or some of the sub-pixels grouped to form a pixel of the display are turned on depending on the intensity of the pixel of the display. Spatial dithering is disadvantageous because resolution is sacrificed in order to display grey levels. In temporal dithering, the "on" voltage of a pixel is varied over a number of frames, depending on the pixel's intensity, to produce an rms value intermediate between $V_{on}^{rms}$ and $V_{off}^{rms}$. Temporal dithering is disadvantageous because it leads to flicker in the displayed pixelated image that can be detected by the human eye.

An alternative to the STN-LCD is shown in FIG. 4 called the active-matrix LCD, or AMLCD 200. In the AMLCD 200, a TN liquid-crystal material 210 is used as before. One common electrode 221 is formed under one alignment layer 212 and a two-dimensional array of electrodes 251, 252, 253,254, 255, 256, 257, 258, 259 (i.e., one for each pixel) is formed under the other alignment layer 214. Furthermore, an active element such as a thin-film transistor or diode (e.g., the transistor 271) is provided for each of the individual electrodes 251–259 of the array. Conductors 281, 282, 283, 284, 285, 286 are provided for each row and column of the matrix, with the gate of each transistor (e.g., the gate 272 of the transistor 271) connected to a corresponding row conductor (e.g., the conductor 284), the source of each transistor (e.g., the source 273) connected to a corresponding column conductor (e.g., the conductor 281) and the drain (e.g., the drain 274) connected to the corresponding pixel electrode (e.g., the electrode 251). When appropriate voltages are applied to the row and column to which a transistor is connected (e.g., the conductors 281 and 284), a voltage appears at the electrode of the pixel (e.g., the electrode 251) which charges a capacitance between the pixel electrode and the common electrode (e.g., the electrodes 251 and 221, respectively). This charge remains until the next time the appropriate charges are applied to the transistor of the pixel. Thus, unlike the STN-LCDs, it is not necessary to use a low duty-cycle drive voltage. The voltage applied to a pixel is usually inverted in succeeding frames.

AMLCDs offer several advantages including superior grey scale to the STN-LCD and the ability to display full-color images. It is also possible to speed up the liquid crystal without affecting frame-response. However, the brightness of the display suffers somewhat because a portion of each pixel is blocked by the opaque layers that form the transistor and the conductors connected thereto. Moreover, in order to construct an AMLCD, a very large integrated circuit having a transistor for each pixel must be fabricated. Thus, the cost of an AMLCD is approximately four times that of an STN-LCD.

An active-addressing solution for STN-LCDs has also been proposed. In such a solution, a faster liquid-crystal material is used in the modulator. In order to overcome the problems associated with the rapid decay of the response of the pixels, each pixel is refreshed several times in one frame. To that end, a set of orthogonal voltage waveforms are applied to several rows at the same time.

The active-addressing solution would reduce the "submarining" effect. However, it is still uncertain if an effective range of grey scales can be provided. Furthermore, the driver circuit is much more complicated because it must generate the orthogonal voltage waveforms and analog column voltages. The driver circuit must calculate the analog column voltages from the orthogonal functions and the pixel information of all the rows at high speed.

In an alternative to using nematic liquid-crystals, a display system has been proposed which uses ferroelectric liquid-crystals. See J. Kanbe, "FLCDs Offer Many Desirable Characteristics" Display Devices 1992, P. 18–20; A. Tsuboyama, Y. Hanyu, S. Yoshihara & J. Kanbe, "S3-1 Invited Characteristics of Large Size, High Resolution FLCD" Japan Display p. 53–56 (1992). Ferroelectric liquid-crystals exist in a smectic C* state. In this state, the molecules tend to line up in layers as shown in FIG. 5(*a*). In the bulk smectic C* state, the molecules are oriented on a cone of angle $\theta$ as shown in the center of FIG. 5(*a*) and with greater clarity in FIG. 5(*b*). The relative angular position of the molecules on this cone rotates by a fixed amount from layer to layer. Near a surface of the substrates 312, 314 in FIG. 5(*a*), the molecules still line up in layers and lie on the surface of the cone, but are forced to choose one of the two positions on the cone which are also parallel to the substrate.

In the exemplary ferroelectric LCD (FLCD) shown in FIG. 5(*c*), a modulator 300 is provided in which the alignment layers have the same direction 322 and 324. Also, the two substrates are brought close together so that a thin liquid-crystal layer is formed between the two substrates 312, 314. The molecules therefore tend to line up in stacked layers as shown near the substrates in FIG. 5(*a*). As shown in FIG. 5(*b*), if an electric field is applied to the liquid-crystal modulator 300 in the direction of the axis through the points A and B, the molecules may be pulled by a dipole moment thereof so that they lie at a particular location C on the cone. Similarly, if an opposite-polarity electric field is applied, the molecules can be pulled so that they lie at an opposite location D of the cone. In either case, the dipole moment per unit volume (polarization) P of the liquid crystal material aligns with the applied electric field.

As shown in FIG. 5(*e*), if a light ray polarized in the direction 301 is directed through the modulator perpendicularly to the alignment of the molecules, an ordinary ray emerges which is polarized in the same direction 302 as the incident ray. If, however, by applying a voltage to the modulator, the molecules can be oriented at a 45° angle to the polarized light, then both an extraordinary and an ordinary ray are obtained. One of the rays has a phase shift with respect to the other ray and thus the emergent combined light ray could have its polarization rotated by 90° if the layer has the right thickness and the phase shift is 180°.

It is necessary to reduce the thickness of the liquid-crystal modulator 300 so that the molecules can only lie in one of two directions a or b in the plane of the layers separated by the angle $2\theta$ as shown in FIG. 5(*c*). It is necessary to reduce the thickness even further to, for example, 1.5 $\mu$m, so that a 180° phase shift between the ordinary and extraordinary rays occurs. The two directions result from a tendency of the molecules to lie on the surface of the cone and to lie in the plane of the alignment layers. Such a liquid-crystal modulator is advantageous because it has a "memory". In other words, if pulled by a voltage in a particular one of the two directions, a or b, the molecules tend to stay in that direction for some time after the voltage is removed unless pulled into the other direction by an opposite voltage.

A flat-panel display 400 using active row-backlights and LCD column shutters is shown in FIG. 5(*d*). See U.S. Pat. Nos. 5,083,120, 4,924,215; T. Nelson, M. Anadan, J. Mann & E. Berry "Leaky Lightguide/LED Row-Backlight, Column-Shutter Display" IEEE Transactions on Electron Devices, vol. 38, no. 11, p 2567–69 (1991); T. Nelson, J. Patel & P. Ngo, "Row-Backlight, Column-Shutter Display Concept" Applied Physics Letters, vol. 52, no. 13, March 1988, p. 1034–36; T. Nelson, J. Patel, "Row-Backlight, Column-Shutter Display: A New Display Format" Displays, April, 1989 p. 76–80. Illustratively, the display 400 has an active backlight 410 formed by a number of elongated leaky light guides 411 arranged in parallel rows. Each row 411 is alternately illuminated one row at a time for a row-time interval. The light from these rows is polarized in a particular direction 401 and applied to a liquid-crystal modulator 420 which preferably is made with a ferroelectric liquid-crystal material. Thereafter, the polarization-encoded light beam produced by the liquid-crystal modulator is then revealed by an analyzer 440 which transmits light polarized in the direction 402.

The liquid-crystal modulator 420 has one common electrode 431 formed under one alignment layer 430. The liquid-crystal modulator 420 also has a number of column electrodes 421 formed under the other alignment layer 422, each of which defines a column shutter of the liquid-crystal modulator 420. A pixel is defined by the intersection of a column electrode 421 and a row backlight 411. As before, a voltage is applied between the column electrodes 421 and the common electrode 431 for each row of light depending on whether the corresponding pixel is to be on or off. The voltage applied between each column electrode 421 and the common electrode 431 controls the state, i.e., "on" or "off", of the corresponding column shutter of the liquid-crystal modulator 420.

The active row backlight, column shutter display can produce a multitude of grey scales and hence full color without wasting any light. To produce grey scales, the prior art teaches a pulse-width modulation method in which the column shutters are in the "on" state for only a fraction of the row-interval in which a row of light is transmitted. The state of the column shutters is changed to the "off" state during the row-interval. However, the prior art also teaches that the shutters are changed from the "off" state to the "on" state before the start of the next row-interval to prepare the shutter for the next row of light. Thus, the minimum time for displaying a pixel equals the time required to make two transitions. Viewed another way, a row period may be defined as the time from the beginning of one row-interval when one row backlight becomes active to the beginning of the next row-interval when the next row backlight becomes active. Two column-shutter transitions (i.e., from "off" to "on" and from "on" to "off") are required in each row-period.

This presents a problem for providing higher resolution or full-color displays. Moreover, in order to produce color in a display, it is necessary to provide, for each row of pixels in the display, one row backlight for each of the colors red, blue and green (e.g., by providing red, blue and green leaky lightguides). It is also possible to provide separately driven red, blue, and green sources to each leaky lightguide; and to operate them at different times. In either case, because the frame time should be fixed to avoid flicker, the column shutters must respond, i.e., be able to change from "off" to "on" and from "on" to "off" three times as fast for a given resolution. However, the response time of ferroelectric liquid-crystals cannot easily be increased to this speed if two transitions per row backlight are required.

It is therefore an object of the present invention to provide an LCD flat-panel display device which can produce full color and grey scales. In particular, it is an object of the present invention to provide an active row-backlight, ferroelectric LCD column-shutter display device in which the column shutters need only change states once per row backlight per color per frame.

SUMMARY OF THE INVENTION

These and other objects are achieved by the present invention which provides a flat-panel display device with an active array of parallel longitudinal row backlights disposed in a first plane. The row backlights sequentially emit a row of light for a fixed duration row-interval of time t in successive row periods of duration p. Thus, in each row period of duration p, one row backlight is active for a row-time interval t which is less than the row period of duration p. Each row backlight is illuminated once in each frame. The flat-panel display device also has an array of longitudinal parallel liquid-crystal column shutters disposed in a second plane parallel to the first plane. The shutters are oriented orthogonally to the row backlights so as to define pixels at each intersection of a column shutter and a row backlight.

In order to produce sufficient colors and grey scales, the column shutters make, at most, one transition from the "off" state to the "on" state or vice-versa every row period. This can be achieved in a number of ways. For example, column shutters which have a "memory" may be used. When driven by a particular voltage, these column shutters tend to remain in a particular state, i.e., "on" or "off". Thus, a drive voltage is applied to each column shutter only when it is desired to change the column shutter from one state to the next, i.e., "off" to "on" or vice-versa.

To achieve grey levels, the column shutters are driven so that the transitions occur during the row-interval time in which a row of light is transmitted. As such, the light of the corresponding pixels is transmitted during only a fraction of this row-interval time. For example, a shutter may be in the "off" state for the first 75% of a row-interval time and then changed to the "on" state for the trailing 25% fraction of the row-interval time. In such a case, the pixel is displayed with a 25% intensity. Illustratively, if the column shutter is initially in the "on" state, then the column shutter remains in the "on" state for a leading fraction of the row-interval time, which fraction depends on the intensity of the pixel in the next row. Thereafter, the column shutter changes to the "off" state. If the column shutter is initially in the "off" state, then it illustratively changes to the "on" state for a trailing fraction of the row-interval time and remains in this state until some time in the next row period.

Because the column shutters require, at most, one transition per row period of duration p, it is possible to have twice as many rows as in a conventional active row backlight, column shutter display, which requires two column-shutter transitions per row period.

In a second embodiment, it is not necessary to use a column shutter which remains in the state into which it is driven in order to reduce the number of transitions per row. Instead, the flat-panel display according to the second embodiment is provided with a second unpixelated modulator disposed in a plane parallel to the active row backlights and the column shutters. This second modulator may be disposed between the active row backlights and the column shutters or on the opposite side of the column shutters. The second modulator alternately polarizes the rows of light in two different orthogonal directions, which directions correspond to the "on" and "off" states of the column shutters. The modulator changes between the "on" and "off" states once each row period. Illustratively, the state transitions occur at the falling edge of each row-interval time of the row backlights.

The column shutters operate in conjunction with the modulator to display a pixel. For example, suppose that linearly polarized light produced by the row backlights appears bright if its polarization is not changed and dark if its polarization is rotated 90°. In such a case, a pixel will appear bright if both the corresponding column shutter and the modulator are in the same state, i.e., both "on" or both "off". Otherwise, if the modulator and column shutter are in different states, the pixel will appear dark. Thus, to display a pixel with a certain intensity in a particular row, the column shutter is driven into the same state as the modulator, e.g., the "on" state, for a fraction of the row-interval time which fraction depends on the desired intensity of the pixel. At the end of the row-interval time, the modulator changes its state, e.g., to the "off" state but the shutter remains in its current state, e.g., the "on" state. Thus, at the next row-interval time, the pixel of the next row initially appears dark. As before, the column shutter can then be changed from its current state, e.g., the "on" state, to the same state as the modulator, e.g., the "off" state, for an appropriate fraction of the row-interval time for displaying the pixel in the next row at a desired intensity. The largest fraction in which the pixel can appear bright is delimited by one transition of the column shutter and one transition of the modulator. The number of transitions required to display each pixel is therefore divided between the modulator and the column shutters. Thus, each column shutter makes only one transition per row period. Furthermore., if the modulator is also a liquid-crystal modulator, it too has only one transition per row period.

In short, a flat-panel active row-backlight, liquid-crystal column-shutter display device is provided which is capable of displaying grey scales and full color. The column shutters need only make one transition between states per row period during which a row backlight is active.

BRIEF DESCRIPTION OF THE DRAWINGS

FIG. 5(*b*) illustrates the smectic C* state of a ferroelectric liquid-crystal.

FIG. 5(*c*) depicts a second prior art ferroelectric liquid-crystal modulator.

FIG. 5(*d*) depicts a prior art FLCD.

FIG. 5(*e*) depicts a ferroelectric liquid-crystal modulator transmitting light without rotating its polarization direction.

FIG. 8(*a*) is a second graph illustrating the transmission characteristics of the column shutters and the row backlights of the display shown in FIG. 6.

FIG. 12(*a*) depicts an exemplary column shutter drive-voltage waveform.

FIGS. 12(*b*), (*c*) & (*d*) depict exemplary delay signals inputted to the driver circuit of FIG. 12.

DETAILED DESCRIPTION OF THE INVENTION

Figure 1:
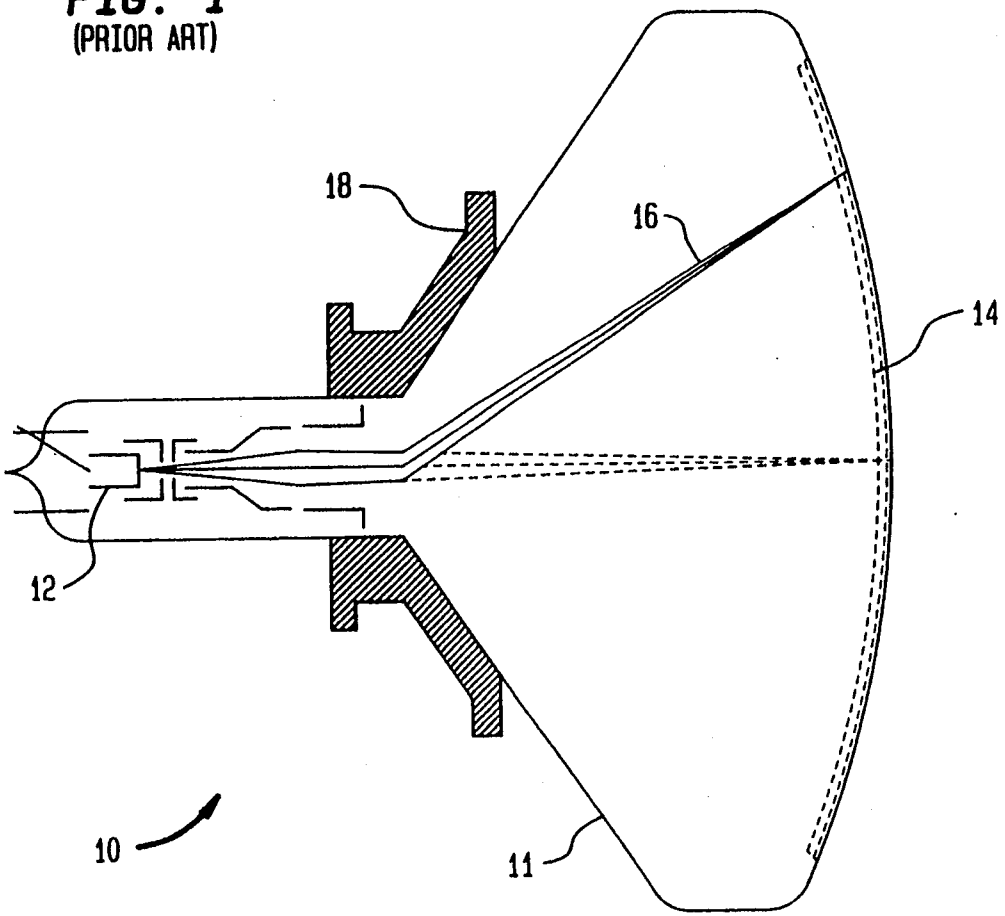
FIG. 1 (PRIOR ART)
FIG. 1 depicts a prior art CRT.
Figure 2A:
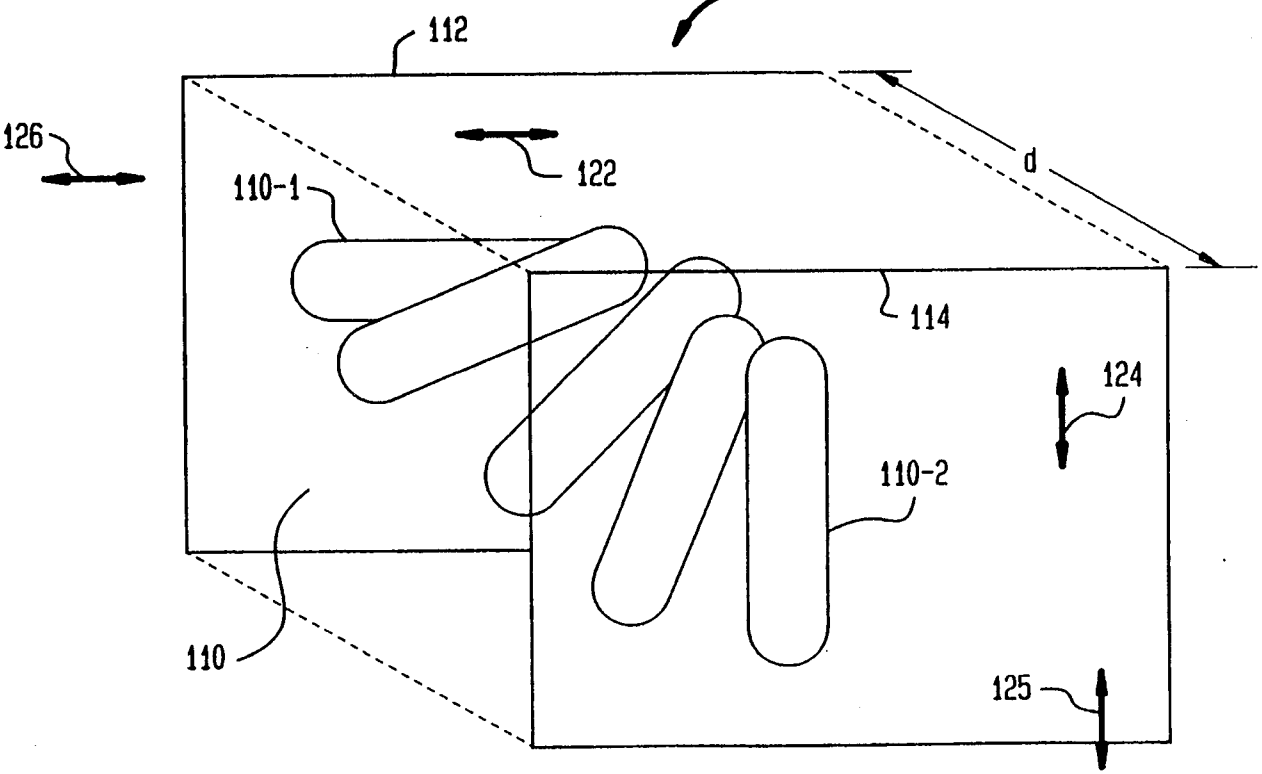
FIG. 2(a) (PRIOR ART)
FIGS. 2(*a*)–2(*b*) illustrate a prior art TN-LCD.
Figure 2B:
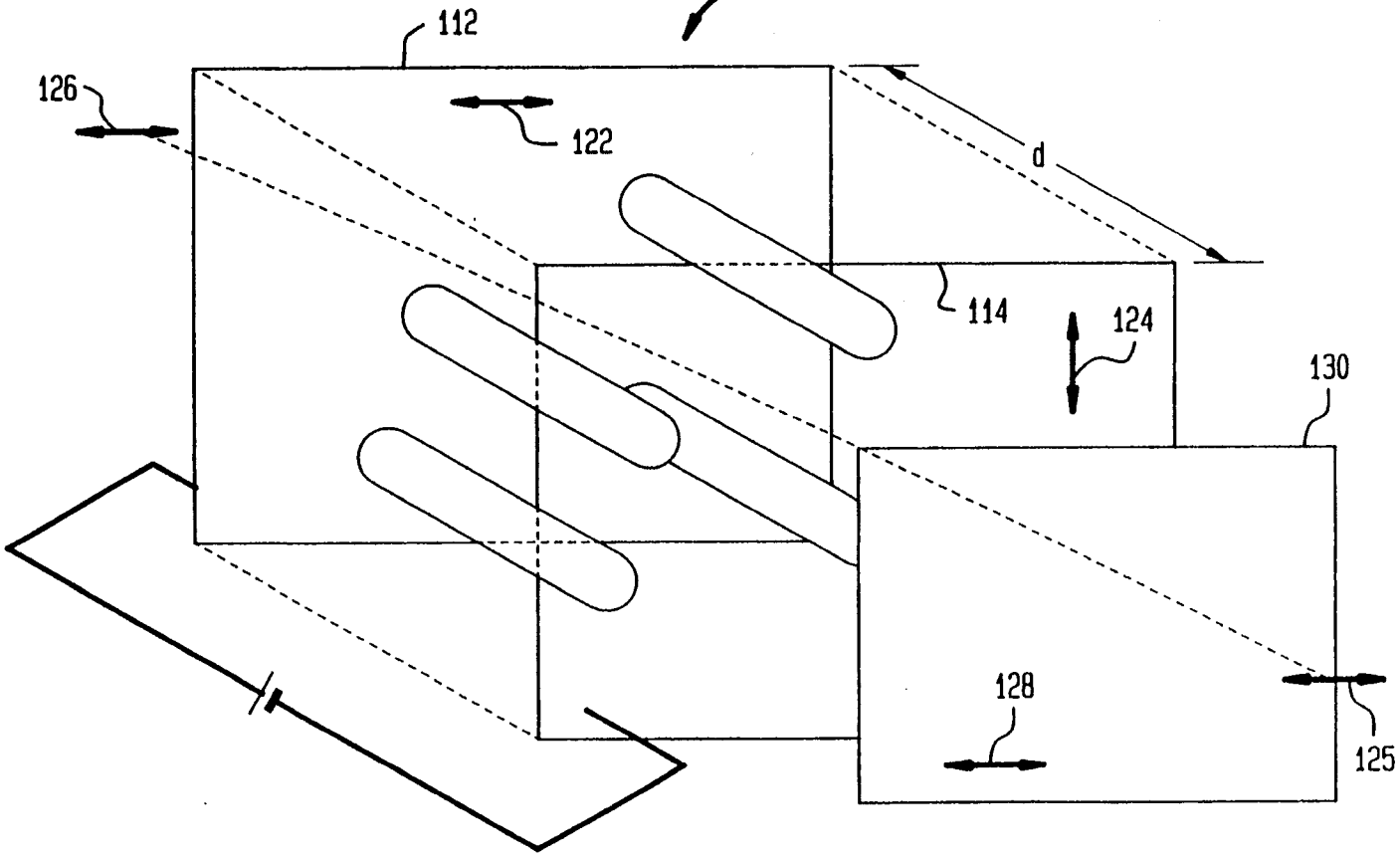
FIG. 2(b) (PRIOR ART)
Figure 3:
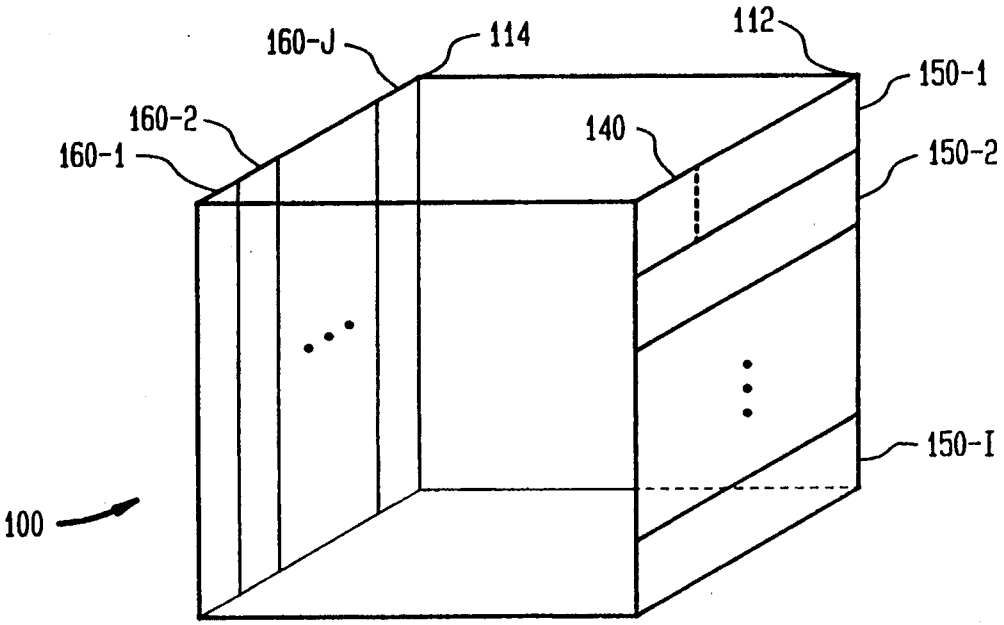
FIG. 3 (PRIOR ART)
FIG. 3 depicts a prior art pixelated TN modulator used in a flat-panel display.
Figure 4:
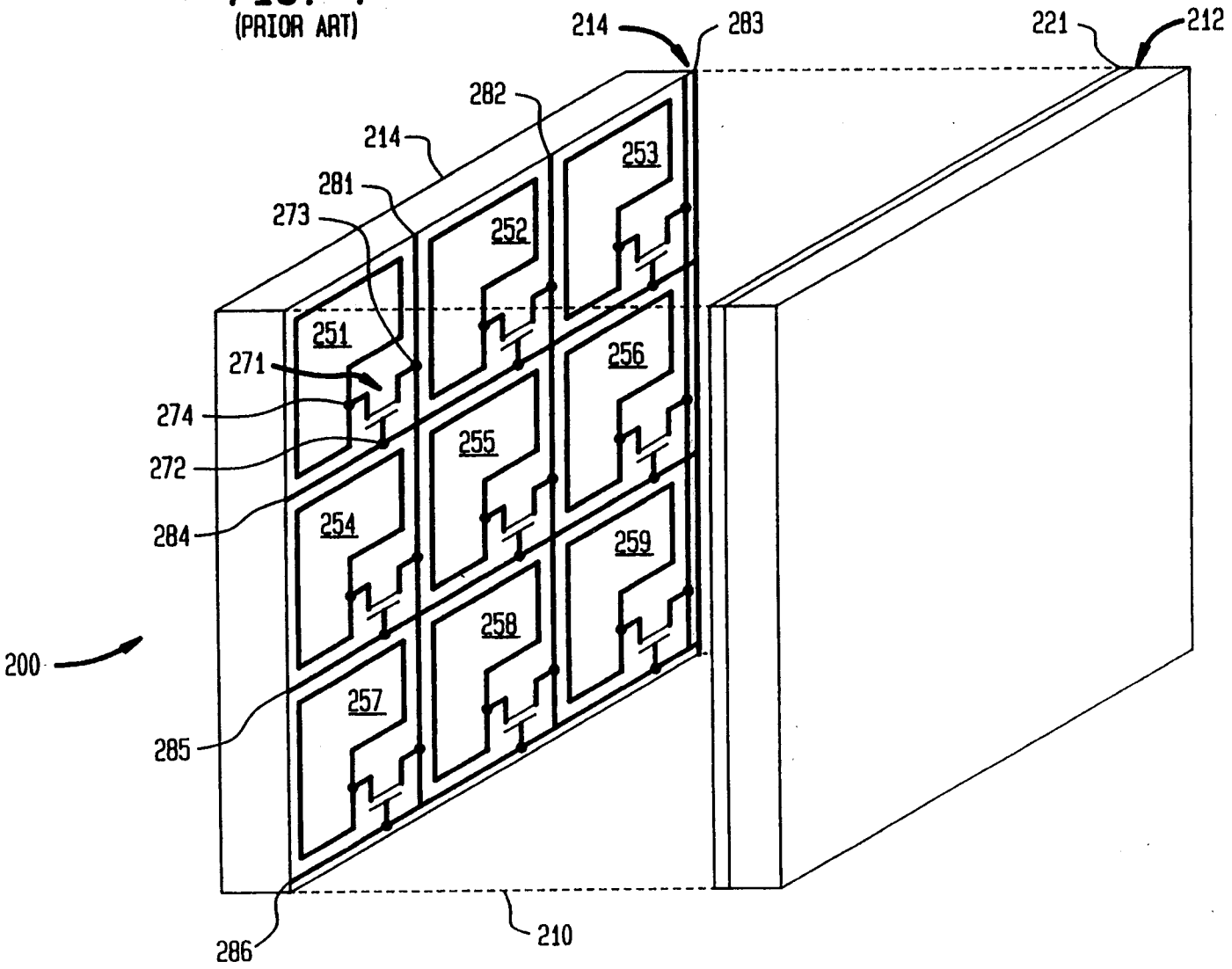
FIG. 4 (PRIOR ART)
FIG. 4 depicts a prior art active-matrix liquid-crystal modulator.
Figure 5A:
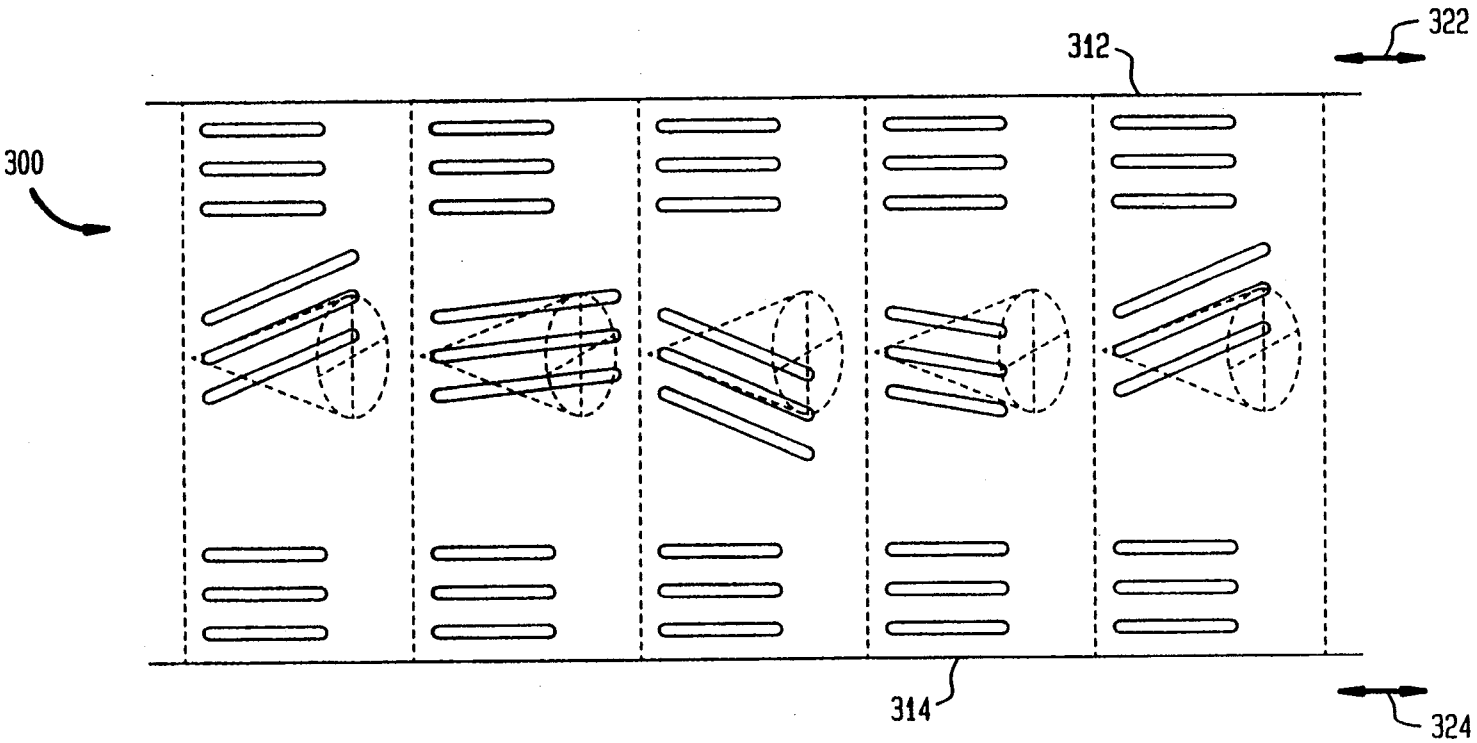
FIG. 5(a) (PRIOR ART)
FIG. 5(*a*) illustrates a first prior art ferroelectric liquid-crystal modulator.
Figure 5B:
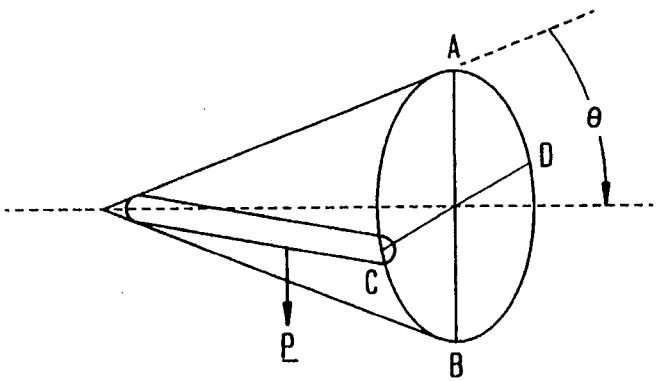
FIG. 5(b) (PRIOR ART)
Figure 5C:
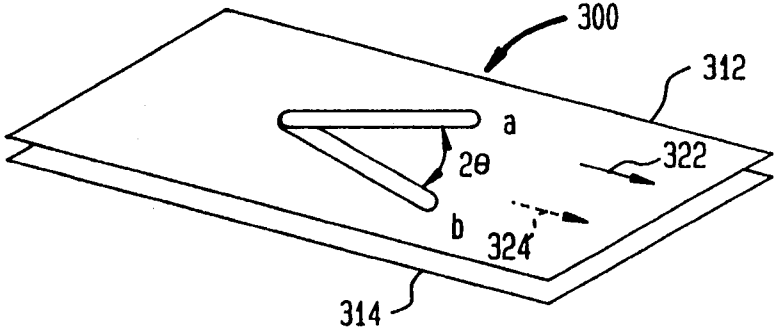
FIG. 5(c) (PRIOR ART)
Figure 5E:
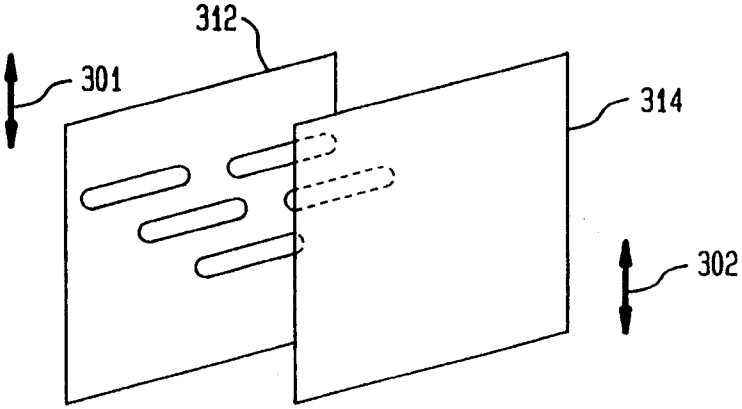
FIG. 5(e) (PRIOR ART)
Figure 5D:
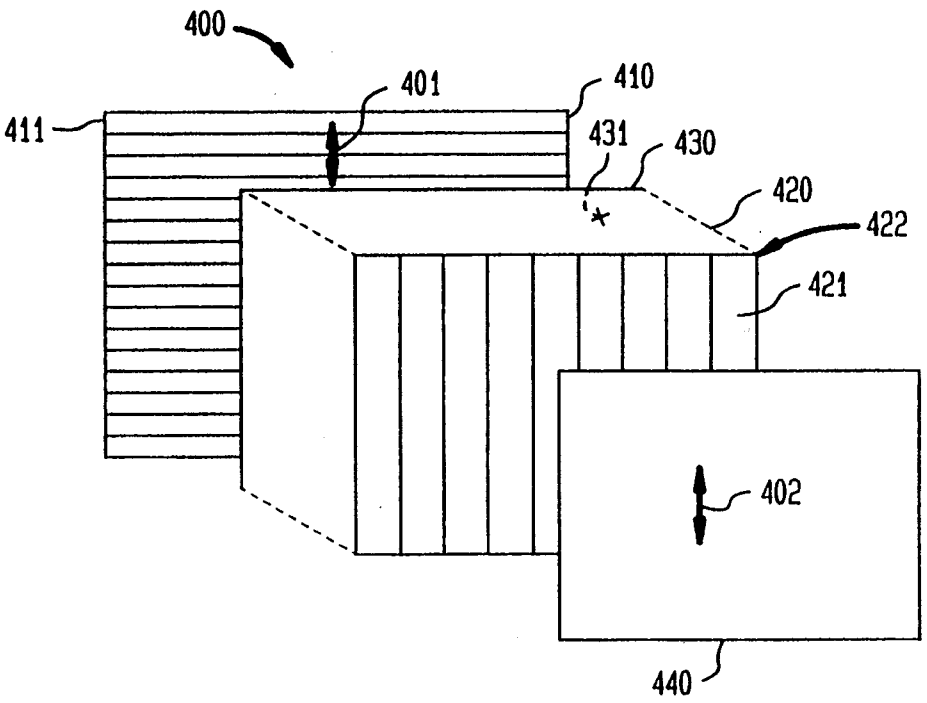
FIG. 5(d) (PRIOR ART)
Figure 6:
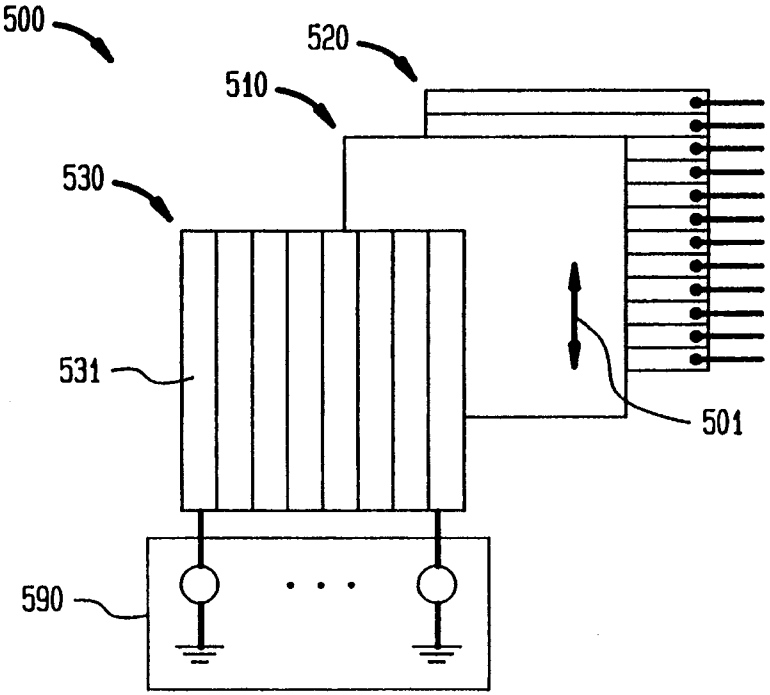
FIG. 6 depicts a first active-backlight display according to a first embodiment of the present invention.
Figure 8A:
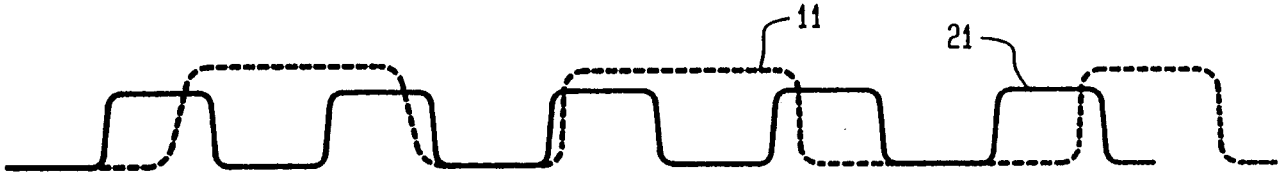
FIG. 8 is a graph illustrating the transmission characteristics of the column shutters and the row backlights of the display shown in FIG. 6.

Referring now to FIG. 6, an active row-backlight, column shutter display 500 according to a first embodiment of the present invention is depicted. The display has active row backlights 520 which are sequentially illuminated for a fixed duration row-interval of time t during successive row periods. A row period may be defined as the time from the beginning of one row-interval in which one row backlight is illuminated to the beginning of the next row-interval in which the next row backlight is illuminated. The row period has a duration p and illustratively $p=2t$ so that a row-interval in which a back light is illuminated occupies half of the associated row period. Each row backlight is illuminated once per frame of time F in a separate row period of duration p.

The light from these rows illustratively pass through a polarizer 510 to produce light which is linearly polarized in a particular direction 501. The linearly polarized light is inputted to a liquid-crystal modulator 530 having a plurality of column shutters (e.g., the column shutter 531) aligned perpendicularly to the row backlights. The column shutters 531 selectively reorient the polarization of the inputted light beam to produce a polarization-encoded image on the light beam. This encoded image may then be revealed by an analyzer (NOT SHOWN). The polarization directions of the inputted light beam and the analyzer are illustratively parallel, although this is only illustrative.

According to a first embodiment, the liquid-crystal modulator 530 has a memory, i.e., once driven into a particular state, a column shutter remains in that state. Illustratively, the modulator comprises a ferroelectric liquid-crystal material sandwiched between two closely spaced alignment layers as shown in FIG. 5(*c*). For example, the alignment layers may be separated by 1.5 μm.

The FLCD 500 according to the invention has a driver circuit 590 which drives the column shutters of the liquid-crystal modulator 531 so that the column shutters change states, at most, once per row period. The driver achieves this end using relatively low voltages which may be produced by conventional integrated circuits, i.e., 10 volts or less. Furthermore, the driver circuit drives the column shutters so that they have a pulse-width modulated transmission characteristic, while not applying any DC voltage to the liquid-crystal modulator.

As stated above, when a ferroelectric liquid-crystal modulator with a memory is driven into one of its two states it tends to remain in that state. The response time (i.e., the time required for changing from one state to the next) of the ferroelectric liquid-crystal modulator is finite. The response time is a function of the voltage level applied to the modulator. It is possible to use a liquid-crystal material which responds in 100 μsec or less for voltages less than 10 volts.

Figure 7:
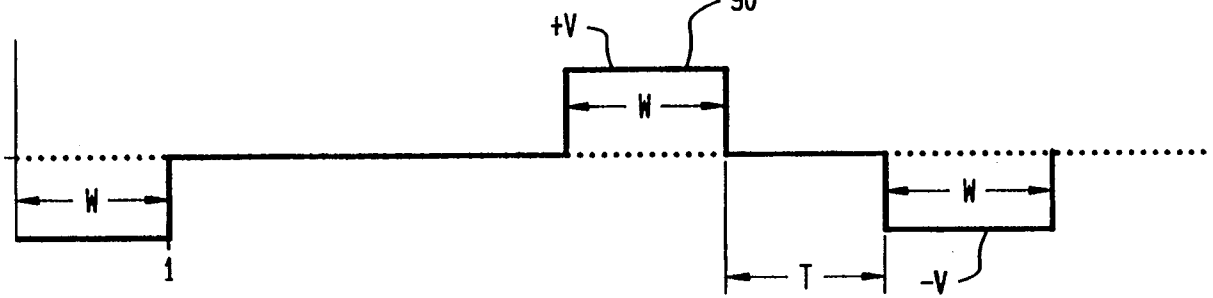
FIG. 7 is a graph illustrating the drive-voltage waveform produced by the column-shutter driver of FIG. 6.

The driver 590 according to the present invention drives each column shutter with a voltage waveform 90 such as depicted in FIG. 7. As shown, to place the column-shutter 531 in one state, e.g., the "on" state, a positive voltage +V is applied to the column shutter 531 for a fixed duration W. For example, W=100 μsec. After a delay caused by the above-mentioned response time of the ferroelectric liquid-crystal material, the column shutter 531 responds so that the column shutter 531 is in the "on" state. Similarly, to place the column shutter 531 in the other state, i.e., the "off" state, a negative voltage −V is applied to the column shutter 531 for a fixed duration W. Otherwise, no voltage is applied to the column shutter 531, in which case the column shutter of the modulator 530 remains in the state into which it was driven.

Figure 8:
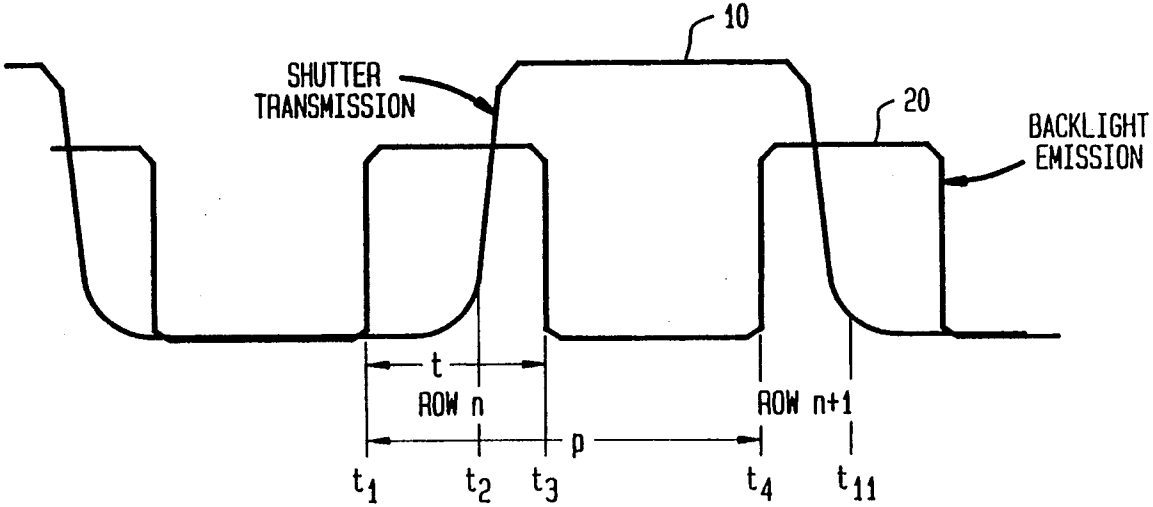

In FIG. 8, the column shutter 531 transmission characteristic function 10 produced by the voltage waveform of the driver 590 is shown superimposed over the emission function 20 of the row backlights. As shown, each of the N row backlights (e.g., the $n^{th}$ row backlight where $1 \leqq n \leqq N$) displayed in a frame of duration F (e.g., 0.033 sec) transmits light to the column shutter 531 for a fixed-duration row-interval of time t which occupies half of the corresponding row period of duration p, where $F=Np$. In FIG. 8, the row-interval t and row period p for the $n^{th}$ row back light are illustrated.

In FIG. 8, at the time $t_1$, the column shutter 531 initially is "off" as the $n^{th}$ row backlight begins to transmit light. The driver 590 applies a voltage +V 90 (FIG. 7) of fixed duration W (FIG. 7). After a brief delay equal to the response time of the ferroelectric liquid-crystal material of the modulator, the column shutter 531 changes to the "on" state at the time $t_2$ and transmits light. The driver voltage 90 then returns to zero (FIG. 7). However, the column shutter remains in the "on" state. At the time $t_3$, the $n^{th}$ row-interval time ends and the pixel in the $n^{th}$ row appears dark. As shown, the column shutter is in the "on" state for approximately 25% of the $n^{th}$ row-interval time, thereby producing a pixel with a 25% intensity.

At the beginning of the $n+1^{th}$ row-interval time, i.e., at the time $t_4$, the column shutter 531 is still in the "on" state because the column shutter 531 has "memory". The driver 590 applies a negative voltage $-V$ 90 (FIG. 7) to the column shutter for a fixed interval W so that the column shutter changes to its "off" state at the time $t_{11}$. Thereafter, the driver voltage 90 returns to zero. Again, the shutter remains in the "off" state. As shown in FIG. 8, this causes the pixel in the $n+1^{th}$ row to receive light for approximately 25% of the time light is emitted by the $n+1^{th}$ row backlight, because the shutter is again transmitting for only 25% of the row-interval time period in which the $n+1^{th}$ row backlight is illuminated thereby producing a pixel with a 25% intensity.

As shown in FIG. 8(*a*), it is also possible to display pixels of different intensities by controlling the pulse-width and synchronization of the column shutter states 11 with respect to the emission of light by the row backlights 21. It may also be appreciated that the drive voltage applied to each column shutter is a series of equal-width pulses (of width W), which pulses alternate in polarity. Only the duration of the periods T (FIG. 8) between the $+V$ and $-V$ pulses, in which no voltage is applied, varies. The duration W of the $+V$ and $-V$ pulses is fixed. Thus, the DC component of the pulses cancel.

As shown in FIG. 8, the transmission characteristic of the column shutters is a non-return to zero, pulse-width modulated function with only one transition per row period p. It may be appreciated that within the constraints imposed by the response time of the ferroelectric liquid-crystal material used and the interval W, the row-interval time t may be made very small. Thus, more rows may be displayed within a given frame time F. These extra rows may be used to increase the resolution of the displayed image or to transmit different colored rows for producing full-color images.

Figure 9:
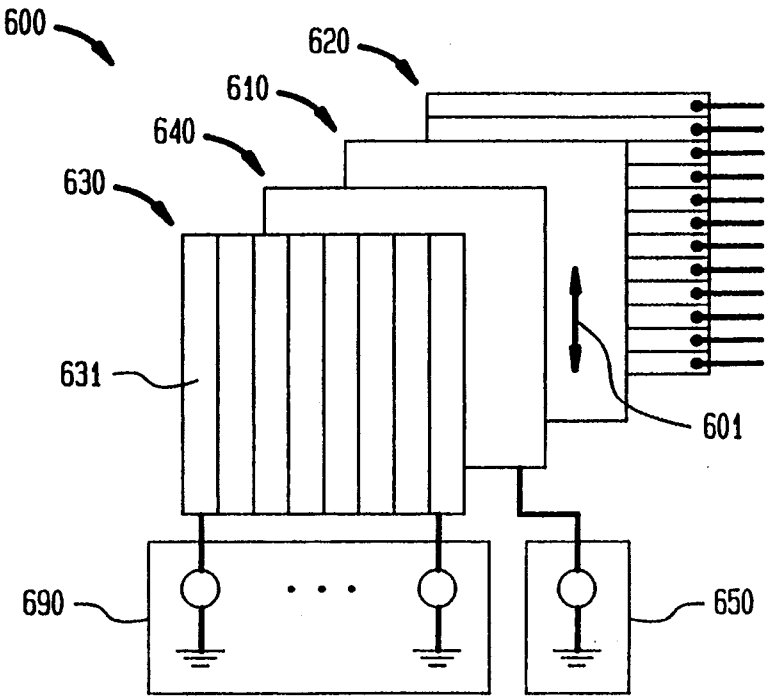
FIG. 9 depicts a second active-backlight display according to the present invention.

A flat-panel display 600 according to a second embodiment of the present invention is shown in FIG. 9. The flat-panel display device 600 is similar to the display device 500 of FIG. 6. The flat-panel display device 600 has active row backlights 620, a polarizer 610 for linearly polarizing the rows of illuminated light in the direction 601, liquid-crystal modulator 630 with column shutters 631 and a driver circuit 690 for driving the column shutters 631 as discussed below. The flat-panel display 600 also has a second unpixelated modulator 640 which is driven by a separate driver 650. As shown, the modulator 640 is interposed in between the row backlights 620 and the liquid-crystal modulator 630 with the column shutters 631, but this is only illustrative. For example, the modulator 640 may also be placed on the opposite side of the column shutters 631.

Illustratively, the modulator 640 is a LCD modulator similar in design to the liquid-crystal modulator 630 with column shutters 631, except that it has only one electrode under each alignment layer which electrodes cover the entire portion of the substrate under the alignment layers through which light passes. Both the modulator 640 and the modulator 630 may be made with ferroelectric liquid-crystal materials. However, it is not necessary for the modulator 630 or the modulator 640 to have a memory, i.e., to remain in the state into which they are driven after the drive voltage is removed.

Illustratively, the analyzer (NOT SHOWN) transmits light with the same polarization direction as the direction 601 of the light transmitted by the polarizer 610. In such a case, if the modulator 640 and a column shutter 631 are both in the same state, e.g., both "on" or both "off", the pixels of the corresponding column will be bright. Suppose that both the modulator 640 and the column shutters 631 are both in the state which does not affect the polarity of the light passing therethrough (e.g., the "on" state). In such a case, neither the modulator 640 nor the column shutters 631 have any effect on the polarization of the light. Thus, the light is transmitted by the analyzer. If the modulator 640 and the column shutters 631 are both in the other state (e.g., the "off" state), each rotates the polarity of the light 90° or 180° total. The net effect is that the direction of the polarization of the light is again parallel with the polarization direction of the analyzer and thus the light is transmitted. In the case that the modulator 640 and the column shutters 631 are in different states, the polarization of the light will be rotated 90°. Since the polarization direction of the light is orthogonal to the direction of the analyzer it is blocked. (In an alternative example, the polarization directions of the analyzer and the polarizer 610 are orthogonal. Light is transmitted when the modulator 640 and the column shutters 631 are in different states. Similarly, light is blocked when the modulator 640 and the column shutters 631 are in the same state.)

Figure 11:
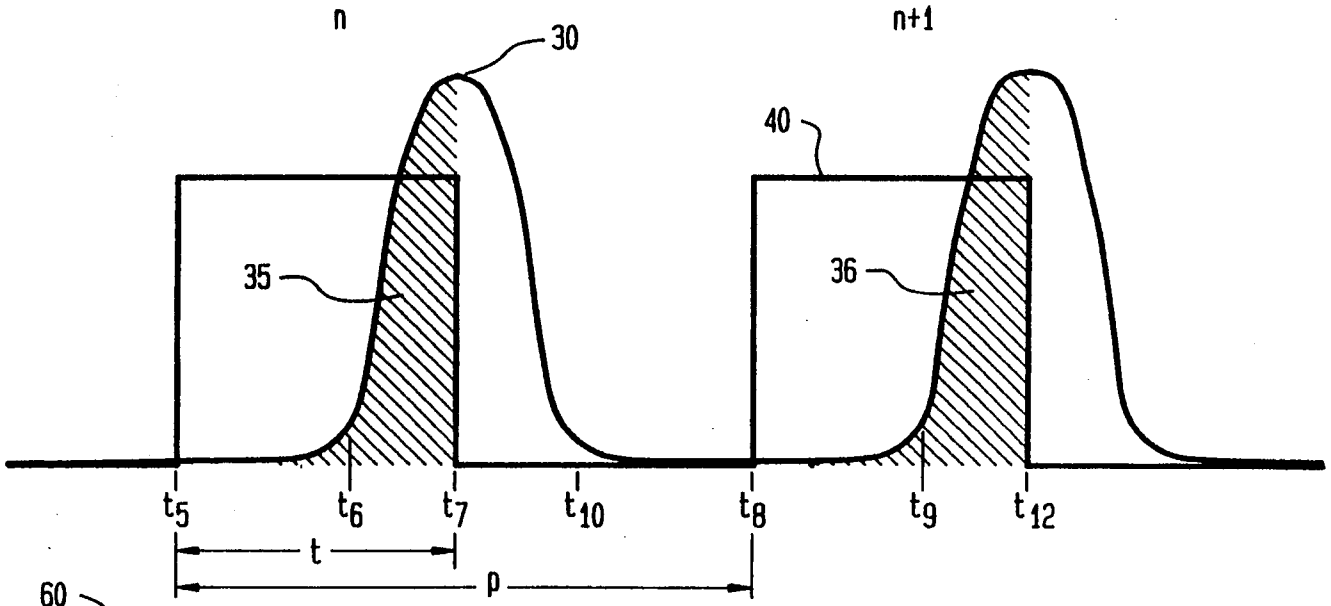
FIG. 11 is a graph illustrating the transmission characteristics of the row backlights, the modulator and the column shutters of the FLCD depicted in FIG. 9.
Figure 10:
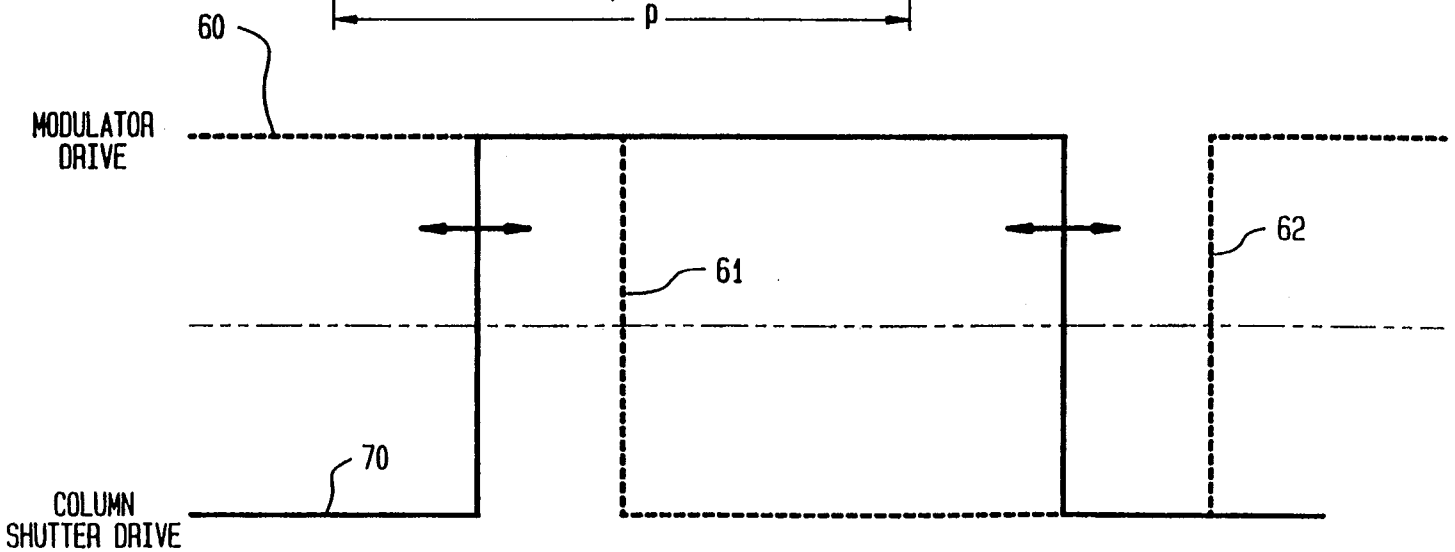
FIG. 10 is a graph illustrating the modulator driver and column-shutter driver voltage waveforms of the active-backlight display depicted in FIG. 9.

FIG. 10 shows the drive voltages 60 and 70 produced by the modulator driver 650 and the column-shutter driver 690, respectively. FIG. 11 shows the corresponding combined modulator 640 and column-shutter 631 transmission characteristic function 30 produced when driven by the corresponding drive voltages shown in FIG. 10. FIG. 11 also shows the row-backlight emission function 40 for the $n^{th}$ and $n+1^{th}$ rows. In operation, the modulator 640 is illustratively driven by the modulator driver 650 so that it alternates between the "on" and the "off" states from one row period to the next. If the modulator 640 comprises a ferroelectric liquid-crystal material, this may be easily accomplished by driving the modulator 640 with a square-wave voltage having a period equal to twice the row period (2p). Illustratively, the rising and falling edges 62 and 61 (FIG. 10) of the modulator drive voltage are synchronized in relation to the ends of each successive row-interval time $t_7$ and $t_{12}$ as depicted in FIGS. 10 and 11.

Each column shutter 631 is driven with a voltage so that the combined effect 30 (FIG. 11) of the column shutter 631 and the modulator 640 produces a pixel of the appropriate intensity for that particular row. As shown in FIGS. 10 and 11, a pixel will appear bright during a fraction of a row-interval which fraction is delimited by one transition of the column shutter 631 and the duration of the light-emitting interval t of the backlight. The subsequent transition of the modulator causes the pixel in the following row to become bright when its backlight begins to emit light. The largest fraction during which a pixel can appear bright is delimited by one transition of the modulator 640 and one transition of the column shutter 631. Thus, two transitions of each pixel, i.e., from bright to dark or vice-versa, in a single row period may be achieved by dividing the transitions between the modulator 640 and the column shutters 631.

The flat-panel display device 600 of FIG. 9 according to a second embodiment of the invention is capable of displaying pixels of different intensities using only a single transition of each column shutter 631 per row period. Assume that the polarization directions of the polarizer 610 and the analyzer (NOT SHOWN) are parallel. As shown in FIGS. 10 and 11, initially, when a row backlight begins transmitting light at the time $t_5$, the modulator 640 and the column shutters 630 are in different states. For example, initially, the modulator 640 is in the "on" state and the column shutter 631 is in the "off" state. The column shutter 631 is then driven into the same state as the modulator 640 at the time $t_6$. Thus, the pixel is bright during a trailing fraction 35 of the row-interval time in which light is transmitted by the $n^{th}$ row backlight. The fraction of time begins at the time of the column shutter 631 transition $t_6$ and ends at the end of the row-interval time $t_7$. Some time after the end of the $n^{th}$ row-interval time $t_7$ (i.e., at the time $t_{10}$), the modulator 640 changes to the "off" state because there is a delay between the modulator drive transition 61 of FIG. 10 and the response of the liquid-crystal modulator 640.

The column shutter 631, however, remains in the "on" state. Thus, at the beginning of the next row-interval of time (time $t_8$) in which the $n+1^{th}$ row transmits light, the column shutters 631 and modulator 640 are once again in different states. As such, at the beginning of the $n+1^{th}$ row-interval time, the pixel in the $n+1^{th}$ row is initially dark. The driver 690 changes the state of the column shutter 631 to the "off" state, at the appropriate time $t_9$ after the beginning of the $n+1^{th}$ row-interval time $t_8$. Thus, as shown in FIG. 11, the pixel in the $n+1^{th}$ row appears bright for a trailing fraction 36 of the $n+1^{th}$ row-interval time from the time $t_9$ to the time $t_{12}$.

It may be appreciated that if in each row, the pixel intensity of all the pixels in the column is the same, there is no net DC voltage applied to the column shutters 631. This is because the column shutters 631 are each driven with a symmetrical waveform that is merely shifted in time, depending on the intensity of the pixels in that column. In the case that the intensity does vary from row to row, the driver 690 does produce a voltage having a DC component. In the worst case, the pixels alternate between 100% and 0% intensity. This can be remedied and the DC-component cancelled by reversing the polarities of the drive voltages of the column shutters 631 and the modulator 640 at the beginning of alternate frames.

The use of a liquid-crystal modulator 640 of the same type as the column shutters 631 provides an additional optical benefit. When the molecular directions of the modulator 640 and column shutters 631 are oriented at right angles to one another, the net birefringence of the combination of the modulator 640 and the column shutters 631 cancels. This suppresses the light that could leak at large angles in the dark state thereby improving the contrast and viewing angle of the display. The leakage arises because the liquid-crystal materials used in the modulator 640 and the column shutters 631 (e.g., ferroelectric liquid-crystal materials) do not exactly function in an ideal manner to rotate the polarization of the incident light rays. It is also possible to use polymer compensation films to cancel the birefringence. See T. Scheffer, "Supertwisted Nematic (STn) LCDs," 1992 SID Seminar Lecture Notes, Society for Information Display, vol. 2, p. M-1/1 to M-1/52. However, such films tend to be more costly and do not compensate the LCD perfectly.

Figure 12:
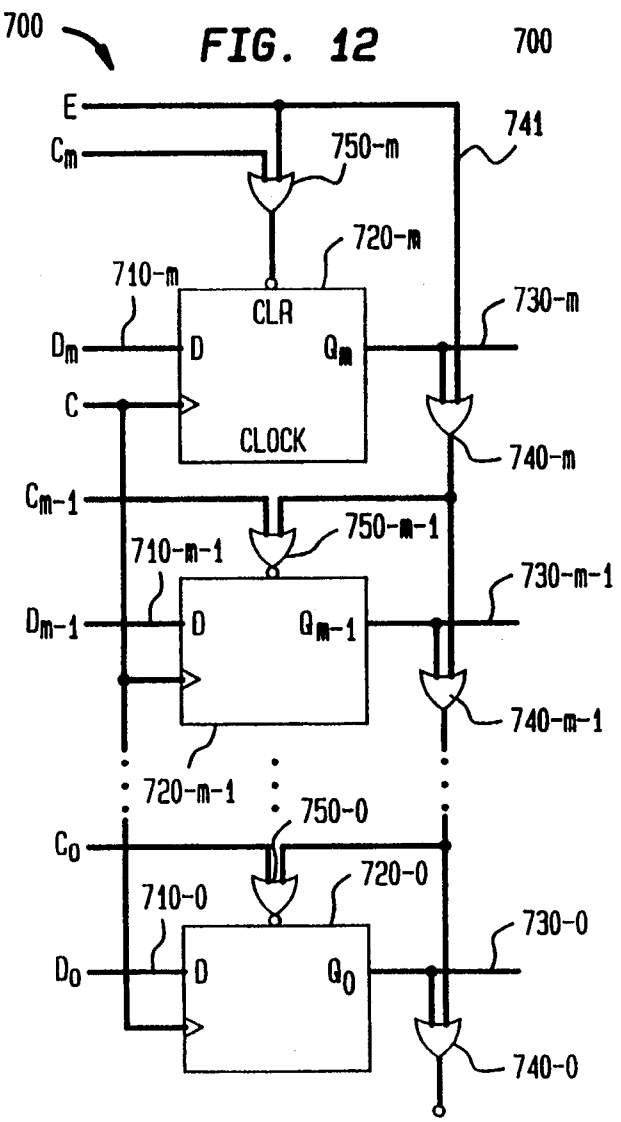
FIG. 12 depicts an exemplary driver circuit for use in the FLCD according to the first and second embodiments of the invention.
Figure 12:
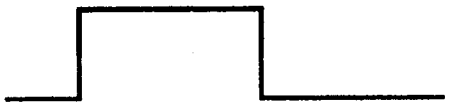
Figure 12:
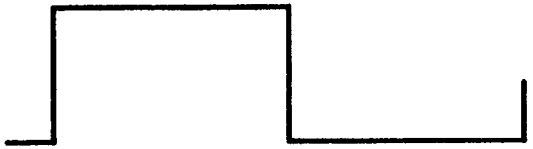
Figure 12:
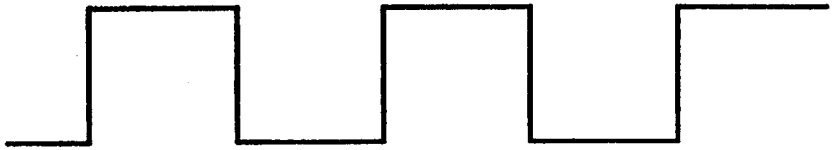
Figure 12:
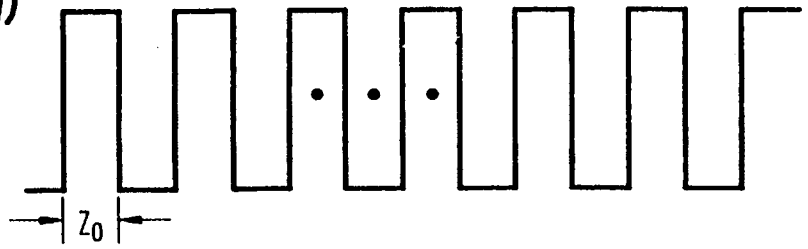

Referring now to FIG. 12, an exemplary driver circuit 700 for driving the column shutters 531 (FIG. 6) or 631 (FIG. 9) of either the first or second embodiment is shown. The driver circuit 700 depicted in FIG. 12 is one cell of a shift register. Each cell is for generating a pulse at a particular time having a designated width, such as shown in FIG. 12(*a*). This pulse is then used to drive a single shutter of a modulator as discussed below. Thus, one such cell 700 must be provided for each column shutter.

Each cell 700 stores a data word $D_mD_{m-1}\ldots D_0$ bits in the flip-flops 720-m, 720-m-1, . . . , 720-0. The data words may be shifted into the flip-flops 720-m, 720-m-1, . . . , 720-0 on the lines 710-m, 710-m-I, . . . , 710-0. The output of each flip-flop 730-m, 730-m-1, . . . , 730-0 is connected to a corresponding OR gate 740-m, 740-m-1, . . . , 740-0 (as well as to the inputs of the corresponding flip-flops in the next cell). Each of the OR gates 740-m-1, . . . , 740-0 also receives the output of a preceding OR gate e.g., the OR gates 740-m, 740-m-1, etc. The OR gate 740-m receives an enable input signal E via the line 741, the function of which is discussed below. The line 741 also provides the E signal to an OR gate 750-m which is connected to a clear input of the flip-flop 720-m. Furthermore, the output of the OR gate 740-0 serves as the output of the cell.

Each of the flip-flops 720-m, 720-m-1, . . . , 720-0 receives a delay signal $C_m$, $C_{m-1}$, . . . , $C_0$ as shown in FIGS. 12(*b*), (*c*) and (*d*). The delay signal $C_m$ applied to the flip-flop 720-m is a square-wave signal with a particular frequency. The delay signal $C_{m-1}$ applied to the flip-flop 720-m-1 is a square-wave signal having twice the frequency of the delay signal $C_m$ applied to the flip-flop 720-m. Similarly, the delay signal applied to each successive flip-flop is a square wave with twice the frequency of the delay signal applied to the preceding flip-flop.

The delay signals $C_m$,$C_{m-1}$, . . . , $C_0$ are inputted to OR gates 750-m, 750-m-1, . . . , 750-0 of the corresponding flip-flops 720-m, 720-m-1, . . . , 720-0. Each OR gate, e.g., the OR gate 750-m-1, also receives the output of the OR gate of the preceding flip-flop, i.e., the OR gate 740-m.

The driver circuit 700 works as follows. Initially, the data words of each cell are shifted into the shift register via the lines 710-m, 710-m-i, . . . , 710-0. During this time, the E signal is a logic one. Since the E signal is a logic one, the OR gate 750-m outputs a logic one to the clear input of the flip-flop 720-m. Because each flip-flop 720-m, 720-m-1, . . . , 720-m-0 is cleared, i.e., reset to logic zero, only when a logic zero is inputted to its clear input, the flip-flop 720-m is not cleared. Furthermore, the output of each OR gate 740-m, 740-m-1, . . . , 740-0 is also a logic one and thus a logic one is inputted to the clear input of each OR gates 750-m-1, . . . , 750-0. Thus, none of the flip-flops 720-m-1, . . . , 720-0 are cleared.

After the data word $D_mD_{m-1}\ldots D_0$ is loaded into the flip-flops 720-m, 720-m-1, . . . , 720-0, the cell may be enabled by changing the E signal to a logic zero. It may be appreciated that the outputs of all of the flip-flops 720-m, 720-m-1, . . . , 720-0 are OR'ed together by the OR gates 740-m, 740-m-1, . . . , 740-0. Thus, provided that the data word $D_mD_{m-1}\ldots D_0$ is not zero, the output of the OR gate 740-0 is a logic one. This value may be used to directly drive a column shutter (e.g., the column shutter 631). Alternatively it may be used as an enable signal to cause another circuit (NOT SHOW) to drive the column shutter. For example, the outputted logic value of the OR gate 740-0 may toggle a flip-flop that controls an analog output voltage which drives a column shutter 631 in the embodiment depicted in FIG. 9. Alternatively, the outputted logic value could toggle a flip-flop which in turn would trigger one of two monostable ("one shot") circuits. In this manner, fixed width pulses which alternate in polarity in alternate row periods may be generated for driving a column shutter 531 in the embodiment depicted in FIG. 6.

Each flip-flop, for example, the flip-flop 720-m-1 cannot be cleared until all of the flip-flops preceding it, i.e., the flip-flop 720-m, are cleared. This is because the output line 730-m feeds a logic one (via the OR gate 740-m and the OR gate 750-m-1) to the clear input of the flip-flop 720-m-1 (and all other flip-flops below, in a similar fashion). Even if the preceding flip-flop 720-m is cleared, the flip-flop 720-m-1 cannot be cleared until the delay signal $C_{m-1}$ inputted to the OR gate 750-m-1 is a logic zero. For example, assume that only the bits $D_{m-1}$ and $D_0$ of the inputted data word are logic one. Initially, after the E signal changes to a logic zero, the flip-flop 720-m-1 clears after one-half the period of the delay signal $C_{m-1}$. Once cleared, the next flip-flop below the flip-flop 720-m-1 which stores a logic one may be cleared, e.g., the flip-flop 720-0, and so on. Again, the flip-flop 720-0 is cleared after a delay equal to half the period of the delay signal $C_0$. Once all of the flip-flops are cleared, the OR gate 740-0 outputs a logic zero.

Assume $Z_0$ (FIG. 12 (*d*)) equals one-half of the period of the delay signal $C_0$. It may be appreciated that a logic one is outputted from the circuit 700 for a time approximately equal to $Z_0 \cdot (D_m \cdot 2^m D_{m-1} \cdot 2^{m-1} + \ldots + D_0)$.

The circuit 700 may be duplicated, so that one set of flip-flops may be loaded while the other is counting. However, if the number of columns is not too great compared to the speed of the circuit 700, shifting and counting can alternate. For example, if the row period is approximately 64 μsec and the row-interval is 32 μsec, then there are 32 μsec wherein a transition may not be needed. Assuming a shift rate of 8 MHZ, the number of column shutters that can be accommodated on a single integrated circuit is 256, which is more than adequate. Furthermore, if each cell has a capacity for receiving an eight-bit data word, then 256 outputs are possible which is considered adequate grey-level resolution for visual displays.

In short, an active row-backlight LCD column-shutter display is provided in which the column shutters need only make one transition per row period. This enables increasing the number of rows to increase resolution or to provide for color rows. Furthermore, the display has a broad range of grey scales so that full color images may be achieved.

Finally, the aforementioned embodiments are intended to be merely illustrative. Numerous other embodiments may be devised by those having ordinary skill in the art without departing from the spirit and scope of the following claims.

I claim:

1. A display producing gray-scale images by means of data lines responsive to pulse-width modulation and driven by a circuit that comprises a shift register having one cell for each data input of the display, each cell comprising:

a memory for periodically receiving and storing an m+1 bit number $D_m D_{m-1} \ldots D_0$, the $m^{th}$ bit $D_m$ is the most significant bit and wherein the $0^{th}$ bit $D_0$ is the least significant bit, said memory comprising a plurality of flip-flops each for storing a bit of said m+1 bit number, means for receiving m+1 delay signals which each correspond to one of said m+1 bits and applying said delay signals to a clear input of corresponding ones of said flip-flops, the delay signal associated with each bit having twice the period of the delay signal associated with a preceding bit, said delay signals setting each bit to logic zero, one at a time from the $m^{th}$ bit to the $0^{th}$ bit, after a delay equal to one half the period of the delay signal corresponding to the bit, an OR circuit connected to an output of each of said flip-flops and to the output of the preceding OR circuit, said output of each OR circuit also being connected to said clear input of the succeeding flip-flop except for the OR circuit corresponding to the $D_0$ bit, and a cell output for driving said associated shutter with a voltage depending, at any time, on whether said m+1 bit number stored in said memory is zero or non-zero, said cell output being the output of said OR circuit corresponding to the $D_0$ bit.

2. A circuit for producing digitally controlled pulse-width modulated outputs from the stages of a shift register, each stage comprising a memory for periodically receiving and storing an m+1 bit number $D_m D_{m-1} \ldots D_0$, where the $m^{th}$ bit $D_m$ is the most significant bit and wherein the $0^{th}$ bit $D_0$ is the least significant bit, said memory comprising a series of memory elements each for storing a bit of said m+1 bit number, means for receiving m+1 delay signals which each correspond to one of said m+1 bits and applying said m+1 delay signals to clear inputs of corresponding ones of said memory elements, the delay signals associated with each bit having twice the frequency of the delay signal associated with a preceding bit, said means for receiving and applying said delay signals resetting each bit which is a logic one to logic zero, one bit at a time from the $m^{th}$ to the $0^{th}$ bit, after a delay equal to one half the period of the delay signal corresponding to the bit, OR circuit means comprising series connected OR circuits, the output of the last of said series connected OR circuits being the output of said stage, said OR circuits connecting the output of each memory element to the clear input of the succeeding memory element and to said output of said stage for producing said pulse-width modulated outputs, and means for providing an enable signal as an input to the clear input of the memory element for the most significant bit and to the first of said series connected OR circuits.

* * * * *